United States Patent [19]

Saltzman

[11] Patent Number: 4,514,907

[45] Date of Patent: May 7, 1985

[54] BOW AND ARROW SIGHTING DEVICE

[76] Inventor: Leonard F. Saltzman, 14 Sandybrook Rd., Burlington, Mass. 01803

[21] Appl. No.: 631,874

[22] Filed: Jul. 18, 1984

Related U.S. Application Data

[60] Division of Ser. No. 357,726, Mar. 12, 1982, which is a continuation-in-part of Ser. No. 265,361, May 20, 1981, abandoned, which is a continuation-in-part of Ser. No. 63,464, Aug. 3, 1979, abandoned.

[51] Int. Cl.[3] ..... F41G 1/46

[52] U.S. Cl. ..... 33/265; 33/284; 124/87; 356/21

[58] Field of Search ..... 33/265, 284, 227, 287; 356/9, 21, 247; 124/87

[56] References Cited

U.S. PATENT DOCUMENTS

| | | | |
|---|---|---|---|
| 2,574,599 | 11/1951 | Stieber | 124/23 R |
| 3,163,697 | 12/1964 | White | 356/9 X |
| 3,666,368 | 5/1972 | Sprandel | 33/265 X |
| 3,667,444 | 6/1972 | Depatie et al. | 33/265 |
| 3,910,700 | 10/1975 | Sprandel | 33/265 X |
| 4,167,333 | 9/1979 | Young et al. | 33/265 |
| 4,178,693 | 12/1979 | Smith | 33/265 |

*Primary Examiner*—William D. Martin, Jr.
*Attorney, Agent, or Firm*—Walter J. Kreske

[57] ABSTRACT

A bow and arrow sighting device for attachment to the bow and comprised of a range finder of the type having a manually rotatable range adjustment wheel which in one embodiment is coupled by gears to a cylindrical cam in operative engagement with a cam follower mechanism which moves a sighting bead element in synchronism with the angular displacement of the range finder range adjustment wheel so that when the range is found with the adjustment wheel the sighting element will be at the proper archer aiming position for arrow trajectory to the target. The one embodiment incorporates a cylindrical cam in operative engagement with the cam follower mechanism. A second embodiment incorporates a sighting glass in place of the sighting bead element and a parallelogram type lever structure is incorporated in the cam follower mechanism for maintaining the sighting glass in proper axis orientation as well as proper archer aiming position for arrow trajectory to the target. A third embodiment incorporates a single plane cam in operative engagement with the cam follower mechanism. And a fourth embodiment incorporates a single plane cam and a sighting bead carried on a sight adjustment arm mounted to rotate about a common axis on the same shaft with the range adjustment wheel.

18 Claims, 20 Drawing Figures

BOW AND ARROW SIGHTING DEVICE

This is a Div. of Ser. No. 357,726, 3-12-82, which is a continuation-in-part of application Ser. No. 265,361 filed May 20, 1981, which is a continuation-in-part of application Ser. No. 063,464 filed Aug. 3, 1979 both now abandoned.

BACKGROUND OF THE INVENTION (1) Field of the Invention

An improved bow and arrow sighting device which in response to manual adjustment of a range finder for determining range to a target automatically adjusts a sighting element for archer aim which thereby effects an initial inclination of the bow and arrow with respect to the target to achieve proper trajectory of the arrow to the target.

(2) Description of the Prior Art

The sportsman who uses an archery bow and arrow for hunting finds that his most troublesome problem is that of aiming to compensate for distance to his target. Since the target may appear anywhere within the range of his bow it becomes extremely important to be able to rapidly and accurately determine the distance to the target and set his bowsight for the determined distance. Existing bowsights fail to solve this problem in that they require guesswork rather than accurate measurement of distance to the target. For example some bowsights such as disclosed in U.S. Pat. No. 3,667,444 provide manual adjustment for distance but leave the bowman to the unreliable task of estimating the distance to the target. To reduce the inaccuracy of such target distance guessing, multisight structures such as disclosed in U.S. Pat. No. 2,574,599 have been developed. These multisight structures carry a plurality of spacers of different width or rings of different diameter together with associated sighting beads or markers spaced a distance from the respective spacer or ring. The archer then selects the particular spacer or ring which frames a target of known size for providing an approximation of distance to the target and utilizes that spacer or ring and sighting marker combination for aiming the bow. While such multiple sight structures may help somewhat in aiming a bow for different target distances, they are limited to preselected known target size.

SUMMARY OF THE INVENTION

The present invention provides for accurate adjustment for distance to the target in a rapid and easy manual manipulation which also automatically sets a sighting element of the bowsight to the proper aiming position for the distance and incorporates other desirable features and advantages. Among the other features and advantages of the present invention are the provision of a bowsight structure which is compact and adaptable for attachment to and use with substantially all archery bows. Another desirable feature and advantage of the present invention is the provision of a bowsight structure which requires only a single sighting element as distinguished from the multiple sighting element bowsight structures heretofore found necessary for approximating different target distances. A further desirable feature and advantage is the provision of a bowsight structure which is applicable to bows having different pull strengths as well as for arrows of different mass.

A primary object of the present invention is the provision of a bowsight structure which provides for a simple manual manipulation for an accurate setting for distance to a target with the same manipulation automatically adjusting the aiming position of the sighting element for the same distance to the target.

Another object is the provision of a bowsight structure which is adjustable for arrows of different mass and to bows of different pull strength.

And a further object is the provision of a bowsight which advantageously incorporates the accuracy of a conconventional optical range finder for establishing the distance adjustment of the sighting element.

The objects, features and advantages of the present invention are achieved generally by the provision of a sighting device which incorporates a range finder of the type having a manually moveable target range adjustment member with a range adjustment displacement corresponding to distance to the target, a sighting element mounted for movement in a vertical plane when the sighting device is fixed to the bow and the bow and arrow are aimed at the target, and a structure in responsive relation to the target range adjustment member for moving the sighting element in the vertical plane in corresponding relation to the range adjustment displacement.

By making the sighting element in the form of a sighting bead and making the structure for moving the sighting bead in the form of a cam and cam follower mechanism makes possible an accurate and repetitively reliable arrangement for adjusting the sighting bead for corresponding distance adjustments of the range finder.

By making the target range adjustment member in the form of a manually rotatable wheel coupled through gears to the cam and cam follower mechanism simplicity and reliability of operation is thereby achieved.

Alternatively, by making the target range adjustment member in the form of a cam fixed to rotate on the same axis with the manually rotatable range adjustment wheel and the sighting element mounted for movement about the same axis with said manually rotatable wheel, further compactness and economy of structure is thereby achieved.

By replacing the sighting bead with a sighting glass and providing a parallelogram type structure for maintaining proper orientation of the glass during its adjustment to proper aiming positions, increased accuracy of aim is thereby achieved.

These and other features, objects and advantages of the invention will be better understood from the following description taken in connection with the accompanying drawings.

DETAILED DESCRIPTION OF THE PREFERRED EMBODIMENTS

Figures 1, 2, 3, 4, 5, 6, 7, 8, 9:
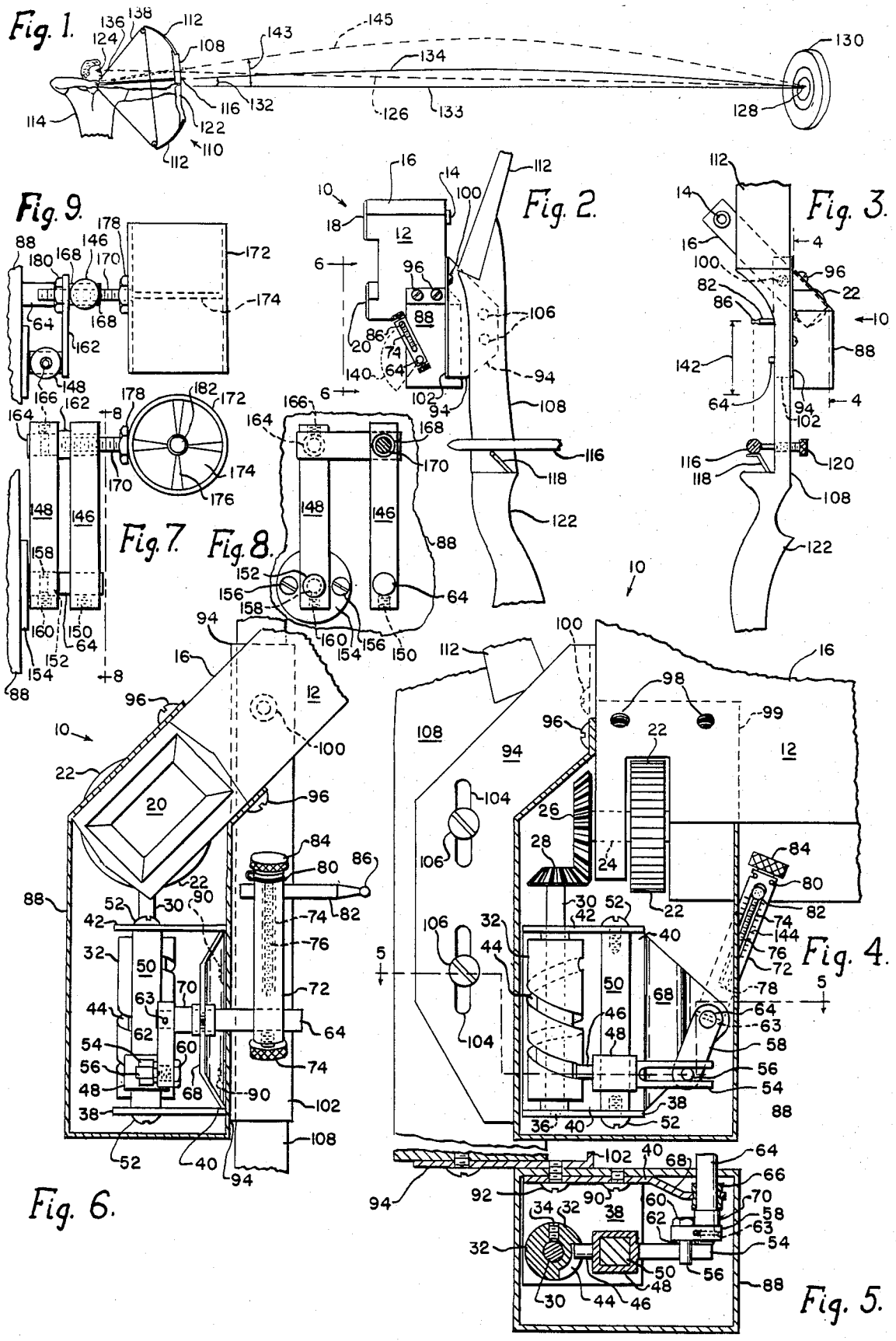
FIG. 1 is a view of an archer aiming a bow and arrow at a target and showing possible trajectories of the arrow for more clearly describing construction and operation of the present invention.
FIG. 2 is a side elevational view of a sighting device constructed in accordance with the present invention and mounted to the rigid center poirtion of an archery bow, only a portion of which is shown together with a portion of an arrow.
FIG. 3 is a rear view of the FIG. 2 illustration.
FIG. 4 is a view to enlarged scale taken on line 4—4 of FIG. 3.
FIG 5 is a cross sectional view to the same scale as FIG. 4 and taken on line 5—5 of FIG. 4 to more clearly show construction of the cam and cam follower mechanism of the invention.
FIG. 6 is a view to the same scale as FIG. 4 and taken on line 6—6 of FIG. 2 with the front wall of the cam and cam follower mechanism housing removed to more clearly show construction of the cam and cam follower mechanism.
FIG. 7 is a view to the same scale as that of FIG. 4 of a sighting glass embodiment of the invention wherein the sighting glass replaces the sighting bead of the FIG. 2 embodiment and a parallelogram structure maintains the sighting glass at all times in operative position with respect to an archer taking aim at a target.
FIG. 8 is a side view of the FIG. 7 illustration and taken on line 8—8 of FIG. 7 to more clearly show the parallelogram structure.
FIG. 9 is a top view of the FIG. 7 illustration.
Figure 10:
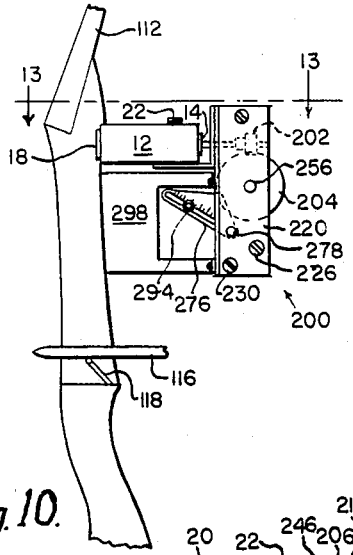
FIG. 10 is a side elevational view of a third embodiment of a sighting device in accordance with the present invention and mounted to the rigid center portion of an archery bow, only a portion of which is shown together with a portion of an arrow.
Figure 11:
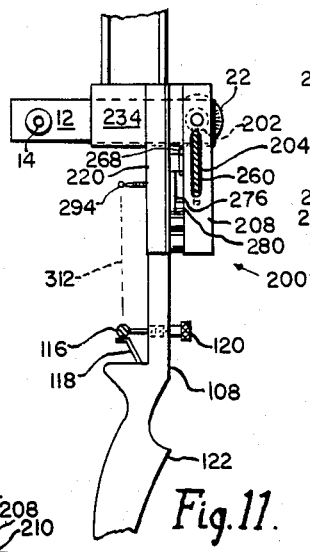
FIG. 11 is a rear view of the FIG. 11 illustration.

Referring to the drawings in more detail, one embodiment of an archery bow sighting device constructed in accordance with the present invention is designated generally by the numeral 10. The archery bow sighting device 10 has a conventional range finder 12, for example such as the coincident image range finder known as "Ranging 50" commercially available from Ranging Inc. of East Rochester, N.Y. The range finder 12 has a viewfinder window 14 at the backside of the rangefinder housing 16, for viewing a target image appearing on each of two mirrors (not shown) behind windows 18 and 20 respectively at the fron of the range finder housing 16. The range finder 12 has a manually rotatable range adjustment wheel 22 which, when manually rotated until the target images appearing in the viewfinder 14 coincide, will result in an angular wheel displacement from a base reference corresponding to the distance to the target.

The range adjustment wheel 22 is fixed to a shaft 24 which also has fastened thereto a bevel driver gear 26 in driving engagement with a driven bevel gear 28 fixed to the end of a cam shaft 30 carrying a cylindrical cam 32 fastened to the cam shaft 30 by a set screw 34 (FIG. 5). The camshaft 30 has a bottom end extension of reduced diameter 36 rotatively carried in an associated hole in the bottom flange 38 of a cam and cam follower mounting bracket 40. The camshaft 30 is also journaled to rotate in an associated hole through a top flange 42 of the cam and cam follower mounting bracket 40 parallel to the bottom flange 38. In the present instance the operating range of the range finder 12 corresponds to a single 360 degree rotation of the range adjustment wheel 22 and the ratio of the effective diameters of the driver bevel gear 26 to the driven bevel gear 28 is 2 to 1 so that the cylindrical cam 32 will make two complete revolutions per single revolution of the range adjustment wheel 22.

The cylindrical cam 32 has a camming groove 44 about its periphery in which is carried one end of a cam follower element 46 extending laterally from cam follower body 48 slidably carried on a cam follower shaft 50 securely fixed at its ends to the bottom and top flanges 38 and 42 respectively by screws 52 in parallel relation to the camshaft 30. A slotted sight actuating member 54 projects laterally from the cam follower body 48 and slidably carries in its slot a slide follower 56 which is rigidly fixed in one end of a sight actuating lever 58. In the present instance the slide follower 56 is a reduced diameter end of a bolt-like member 60 threadably screwed in place in a threaded hole in one end of the sight actuating lever 58. A spacer such as a friction reducing washer 62 provides suitable clearance between the lever 58 and slotted member 54.

The upper end of the sight actuating lever 58 is rigidly fixed, as by dowel pin 63, to the reduced diameter end of a sight lever actuating shaft 64 journaled to rotate in a bearing 66 mounted to a side flange 68 of the cam and cam follower mounting bracket 40. The sight lever actuating shaft 64 has an enlarged diameter body portion 70 between the side of the bearing 66 and the sight actuating lever 58 to cooperate with the washer 62 in constraining the sight lever actuating shaft 64 to only a rotary motion.

Mounted to the other end of the sight lever actuating shaft 64 is a sight lever 72 held in place by a threaded thumb screw 74 running axially at the bottom end of the sight lever 72. The sight lever 72 has a bore and slot 74 located axially thereof and carrying an elongated threaded sight arm adjusting screw 76 rotatably held at one end by a reduced diameter extension 78 in an associated axial hole in the sight lever 72. The other end of the sight arm adjusting screw 76 is constrained to a rotary motion by a spring clip 80 in parallel grooves in sight lever 72 and an associated peripheral groove about an enlarged diameter upper base of the sight arm adjusting screw 76.

The sight arm adjusting screw 76 extends through and threadably engages a threaded hole through a sight arm 82 carried slidably in the slot 74 so that it may be adjusted axially of the sight lever 72 by rotating the enlarged diameter knurled end 74 of the sight arm adjust screw 76. The sight arm 82 carries a sighting bead 86 integral therewith for sighting movement as will be hereinafter further described.

The cam and cam follower mounting bracket 40 is fixed to a cam and cam follower mechanism housing 88 by screws 90 and 92 (FIGS. 5 and 6). Screws such as 92 also fix the cam and cam follower mechanism housing 88 to an archery bow mounting bracket 94. The cam and cam follower mechanism housing 88 is also fixed to the range finder housing 16 by screws 96, two of which in FIG. 4 have been removed and reveal threaded screw holes 98 with the removed portion of the housing 88 being shown by broken lines 99 for more clearly showing internal construction of the invention.

The range finder housing 16 is also fixed by a screw 100 to an angularly disposed flange 102 of the bow mounting bracket 94. The bow mounting bracket 94 has slots 104 for receiving bow mounting screws 106 attaching the bracket 94 to the rigid center portion 108 of a conventional archery bow 110 with resilient end portions 112 which flex to a pull by an archer 114 and provide forward thrust to an arrow 116 upon release by the archer 114. The arrow 116 may be carried on a spring rest 118 and against an adjustable guide screw 120 above the hand gripping portion 122 of the rigid center portion 108 of the bow 110.

The slots 104 of the mounting bracket 94 permit attachment to the archery bow 110 and adjustment to a position such that, after the range finder adjustment wheel 22 has been adjusted for the distance to the intended destination such as point 128 of target 130, the sighting bead 86 with respect to the archer's eye 124 will be on a line of sight 126 directed at the point of destination 128 of the arrow 116 and the arrow 116 will be at an angle 132 with respect to a horizontal line 133 sufficient for a trajectory 134 of arrow 116 to reach the selected destination 128. Thereafter the camming groove 44 operating through the cam follower element 46, slotted sight actuating member 54, slide follower 56, sight actuating lever 58, sight lever actuating shaft 64, and sight lever 72 will cause a corresponding adjustment movement of the sight arm 82 and its sighting bead 86 in response to adjustments of wheel 22 for providing a proper angle 132 for other selected distances to desired arrow destinations such as the destination 128. The configuration of the camming groove 44 may be empirically created by plotting points on the periphery of an ungrooved cam cylinder 32 under carefully controlled bow 110 aiming conditions at several different target distances throughout the range settings of the range adjustment wheel 22 of the range finder 12. Such plotted points on the cam cylinder 32 may then be connected to form a guide line for cutting the camming groove 44 which will thereafter repetitively cause sight lever 72 to be set at corresponding angular positions about the sight lever actuating shaft 64 and thereby the sighting bead 86 to effect a proper angle 132 for the selected distance to the target destination 128 set by the range finder 12. To insure repetitive accuracy of the line of sight 126, a conventional marker or peep sight 136 may be incorporated on the bowstring 138.

The length of the camming groove 44 is such that it limits the angular swing 140 (FIG. 2) of the sight lever 72 to less than 180 degrees so that the sight actuating lever 58 with its slide follower 56 is never permitted to reach a 90 degree angle locking position with respect to the slotted sight actuating member 54. The angular swing 140 which produces a vertical movement 142 (FIG. 3) of the sighting bead 86 of about three inches has been found to provide a sufficient spread for accurate sightings over the effective range of a conventional archery bow.

The repetitive accuracy of the above described sighting procedure assumes the use of arrows which are of the same configuration and mass as arrow 116 and the archer bow 110 pulled by the archer 114 the same amount before releasing the arrow. For arrows of greater mass or weaker archery bows than that for which the camming groove 44 configuration has been made, a larger angle such as 143 would be required and resulting in a higher trajectory 145 to reach the selected destination 128. This increased shooting angle 143 is obtained with the same line of sight 126 by moving the sight arm 82 with sighting bead 86 downward toward the sight lever actuating shaft 64 a controlled amount depending upon the degree of increase in mass of the arrow over that of arrow 116 or degree of reduction of strength of the bow. The sight arm 82 is moved by manually rotating the knurled end 84 of the sight arm adjusting screw 76. By carefully controlled shooting test with different arrows of known different mass values or known different bow strength values may result in calibration marks such as 144 (FIG. 4) and thereby permit the presetting of the sight arm 82 for use with such known different mass arrows or different bow pull strengths.

While the FIG. 1 arrow destination 128 is substantially at the same level as the arrow 116, in some instances the slected target may be substantially higher or lower than the bow 110 and arrow 116. Here again by careful shooting tests, as explained above in the case of arrows of different mass or different poundage pull values of the bow, sight lever 72 may be provided with calibration marks such as 144 for pre-setting the sight arm 82 for such different relative height of target.

Also it will be noted that in FIG. 3 the sighting bead 86 is shown to be on a vertical line with the center of the arrow 116 which is normally the proper positioning for still air archery. In the event a problem such as windage arises which requires a lateral shifting of the sighting bead 86, sight lever 72 may be shifted to the right or left on the sight lever actuating shaft 64 by loosening the thumb screw 74 which thereby permits sliding of the sight lever 72 along the shaft 64 to compensate for such windage or other problem, and locked in position again by manually tightening the thumb screw 74 against the shaft 64.

In the operation of the present invention which has been mounted to the rigid center portion 108 of the bow 110 as described above, the archer 114 needs only to first sight the selected target through the view finder 14 and manually adjust the range finder adjustment wheel 22 to make the selected target images he sees through the view finder 14 coincide. Thereupon such adjustment will automatically cause corresponding adjustment of the sighting bead 86 as previously explained. The archer may then take aim at the target and shoot the bow 110 as explained above.

In a second embodiment of the invention shown in FIGS. 7, 8 and 9, the sight lever 72 with its sight arm 82 and sight bead 86 are replaced by a parallelogram structure comprised of two parallel sight control levers 146 and 148. The lever 146 is mounted at its lower end on the sight lever actuating shaft 64 where it is firmly held in place by a set screw 150. The sight control lever 148 is mounted at its lower end on a shaft 152 projecting from a flange 154 which is fixed to the side wall of the cam and cam follower mechanism housing 88 by screws 156. The shaft 152 has a groove 158 in which is slidably carried a reduced diameter end of a set screw 160 in an axially disposed threaded hole in the end of the sight control lever 148. A connector member 162 has a grooved shaft 164 projecting through a hole through the upper end of the sight control lever 148. Slidably in the groove of the projection shaft 164 is a reduced diameter end of a set screw 166 which is carried in a threaded hole in the top end of the sight control lever 148. The other end of the connector arm 162 has another shaft 168 projecting through an associated hole at the top of the sight control lever 146, thereby maintaining the shafts 146 and 148 at all times in parallel relation to each other. The lever 148 is angularly moveable about the shaft 152 and lever 146 is angularly moveable integrally with the rotation of the sight lever activating shaft 64. The shaft 168 has a threaded hole axially therethrough and carrying therein a threaded sight arm 170 to one end of which is fixed a conventional sighting tube 172 carrying internally thereof a sighting glass 174 having a sighting pattern 176 thereon. A locking nut 178 on the sight arm 170 is tightened against the sighting tube 172 to hold the sighting tube 172 rigidly in place. Another locking nut 180 on the sight arm 170 is tightened against the connector arm 162 to hold the sight arm 170 firmly in place.

In the operation of the embodiment shown in FIGS. 7, 8 and 9, the center 182 of the pattern 176 provides the function of the sighting bead 86. By means of set screw 150 the initial position of the sight control levers 146 and 148 may be set at the same relative position as the sighting bead 86 and the parallelogram structure will at all times maintain the sighting tube 172 in proper orientation for aiming the archer bow 110 as described in connection with FIG. 1.

A third embodiment of an archery bow sighting device constructed in accordance with the present invention is shown in FIGS. 10 through 15 and designated generally by the numeral 200. To facilitate brevity in description and ease in understanding, the bow and arrow sighting embodiment 200 is shown in FIGS. 10 through 13 as being mounted to a bow and arrow structure like that shown and described with respect to FIGS. 1 through 9 and incorporates a like range finder and therefor such like parts are identified by like numbers as those in FIGS. 1 through 9. However, it should be understood that such similarity of parts are for ease of illustration and understanding only and are not intended to limit the type of bow and arrow structure to which the present sighting invention is applicable.

Referring to FIGS. 10 through 15 in more detail, the bow and arrow sighting embodiment 200 has a driver and driven helical gears 202 and 204 respectively which may be of the species of helical gears usually referred to as a worm 202 in driving engagement with a worm gear 204. The helical gears 202 and 204 are housed in a housing formed by two channel members 206 and 208 closed and held together at their top ends by a rectangular closure block 210, dowels 212 and 214, and a flat head screw 216. The dowels 212 and 214 and screw 216 also hold in place, against a rectangular top closure and spacer block 218, an L cross-sectional shaped mounting member 220.

The bottom end of the housing formed by the channel members 206 and 208 is closed and held in place by a rectangular closure block 222 and a flat head screw 224 screwed through the back wall of the channel member 206 into the end of the closure block 222, and also by a flat head screw 226 which runs through a spacer bushing 228 into the closure block 222 to also rigidly hold the bottom end of the L shaped mounting member 220 firmly in place against the spacer bushing 228. A flat head screw 230 through another spacer bushing 232 is screwed into the side of channel member 206 to provide further rigidity and stability to the housing structure for carrying further components in the space between the channel members 206 and 208 and the L shaped mounting member 220 to be hereinafter further described.

A range finder mounting bracket 234 is fastened by flat head screws 236 and 238 to the top back side of the channel member 206 and leg 240 of the L shaped mounting member 220 respectively. The range finder mounting bracket 234 has a bracket extension 242 running rearwardly perpendicular to the channel member 206 and L shaped mounting member 220 and forming a platform-like rest for mounting thereon the range finder 12 by a range fiber mounting screw 244 passing through the range finder housing 16 into the range finder bracket extension 242. The range finder 12 is positioned so that its range adjustment wheel 22 has its axis aligned with and is fixed to a shaft 246 which also has fastened thereto by a set screw 248 the helical worm or driver gear 202 and is journaled to rotate in holes through the respective opposing base walls of the channel members 206 and 208 and having a common axis with the axis of the range finder adjustment wheel 22. The internal side walls of the channel member 208 have cylindrical cutout portions 250 to provide clearance for the periphery of the helical drive gear 202.

The helical driven gear 204 is fixed by a set screw 252 in the helical driven gear hub 254 to a camshaft 256. The camshaft 256 is journaled to rotate in axially aligned holes in the side walls of the channel member 298 and leg 258 of the L shaped mounting member 220 with its axis in perpendicular relation to the axis of the driver gear shaft 246. Slot openings 260 and 262 in the back and front opposing base walls of the channel members 208 and 206 respectively provide suitable clearance for the driven helical gear 204.

Figure 12:
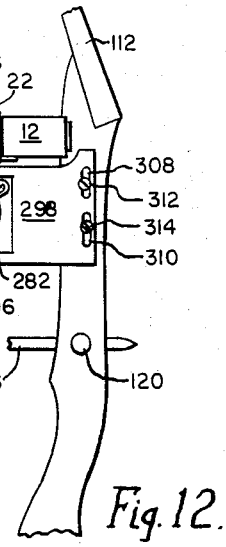
FIG. 12 is a side elevational view of the FIG. 10 illustration showing the opposite side from that in the FIG. 10 illustration.
Figure 13:
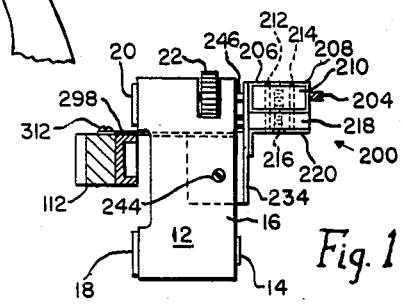
FIG. 13 is a plan view of the FIG. 10 embodiment taken on line 13—13 of FIG. 10.
Figure 14:
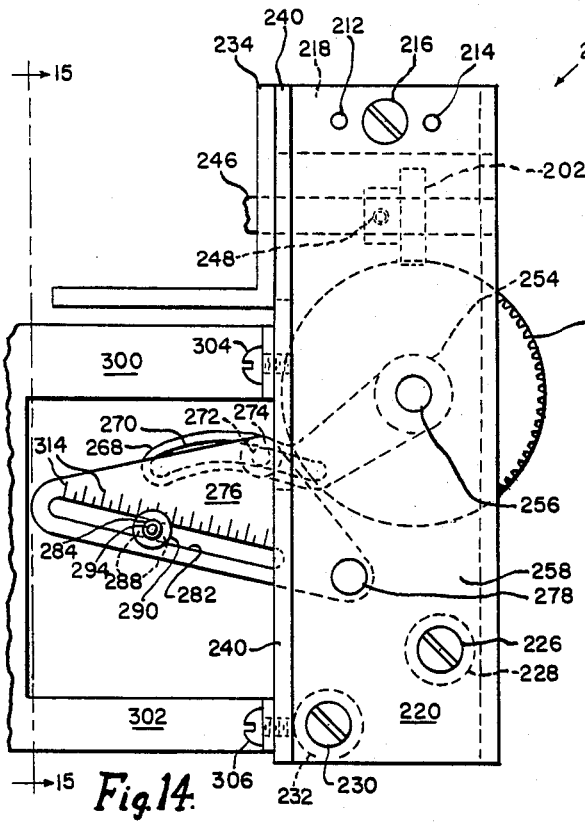
FIG. 14 is a side elevational view of a portion of the FIG. 10 embodiment to enlarged scale to more clearly show construction and with range finder and the rigid center of the bow removed and a portion of the mounting bracket cut away.
Figure 15:
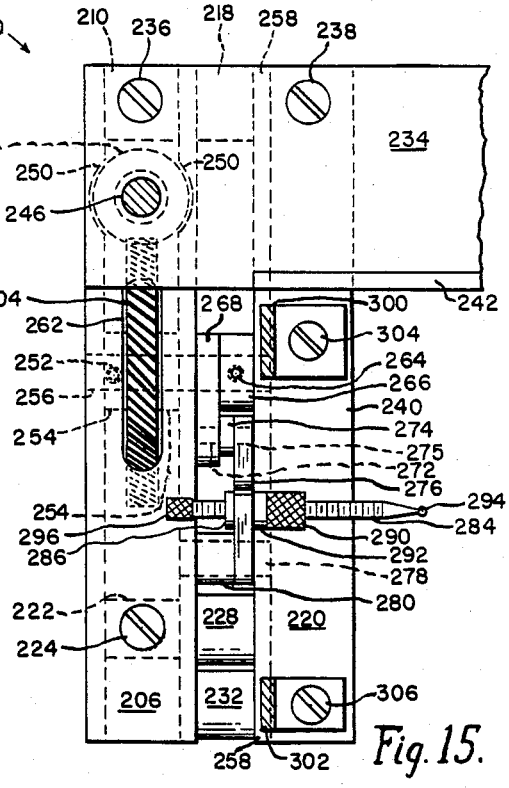
FIG. 15 is a view taken on line 15—15 of FIG. 14 and to the same scale as the FIG. 14 illustration.

Also fixed to the camshaft 256 by a cam lever hub set screw 264 in the cam lever hub 266 is a camming arm or lever 268 having a camming slot 270 (FIGS. 12, 14 and 15). Slidably carried in the camming slot 270 is a cam follower pin 272 which is an integral part of a cam follower pin hub 274 rigidly fixed, as by a press fit of a hub pin extension 275 in a hole in the apex of a triangular shaped sighting bead mounting plate 276. The triangular shaped sighting bead mounting plate 276 is mounted to pivot on a pivot shaft 278 carried at its ends in holes in the side of the channel 206 and the leg 258 of the L shaped mounting member 220. A mounting plate spacer sleeve or hub 280 forming an integral part of the mounting plate 276 extends laterally on the pivot shaft 278 to fill the space between the side of the channel 206 and leg 258 to prevent lateral movement of the mounting pate 276 and thereby insure pivotal movement of the mounting plate 276 in a single plane about the pivot shaft 278. The mounting plate 276 has a slot 282 extending radially of the pivot shaft 278. An elongated sighting bead screw 284 is carried in the slot 282 and extends outwardly in perpendicular relation to the mounting plate 276. The sighting bead screw 284 is adjustably held in place in the slot 282 by a threaded bushing 286 having ears 288 extending into the slot 282 to prevent the threaded bushing 286 from rotating, and a threaded nut 290 with knurled outer surface and a washer 292 on the other side of the mounting plate 276 to permit manual tightening against both sides of the mounting plate 276 to hold the sighting bead screw 284 in place. The sighting bead screw 284 has a taper at one end terminating in a sighting bead 294 and has a knurled extension 296 at the other end to facilitate manual rotation of the screw 284 for adjusting the lateral position of the sighting bead 294 as will be hereinafter further described.

A bracket 298 has an upper leg 300 and lower leg 302 terminating in right angle bends fastened by screws 304 and 306 to leg 240 of the L shaped mounting member 220. The other end of the bracket 298 has slots 308 and 310 for adjustably fastening by screws 312 and 314 to the outside surface of the rigid center portion 108 of the conventional archery bow 110. Thereby slots 308 and 310 permit adjustment of the placement of the bow and arrow sighting embodiment 200 to accommodate an archer's style of sighting.

In the operation of the bow and arrow sighting embodiment 200, procedure is similar to that described above with respect to the FIG. 2 embodiment. For example the slots 308 and 310 permit attachement to the archery bow 110 (FIG. 1) and adjustment to a position such that after the range finder adjustment wheel 22 has been adjusted for the distance to the intended destination such as point 128 of target 130, the sighting bead 294 with respect to the archer's eye 124 will be on a line of sight 126 directed at the point of destination 128 and the arrow 116 will be at an angle 132 with respect to a horizontal line 33 sufficient for the trajectory 134 of arrow 116 to reach the selected destination 128. Thereafter the camming slot 270 operating by movement of the camming arm or lever 268 in unison with the helical driven gear 204 caused by the helical driver gear 202 in response to adjustment of the range finder adjustment wheel 22 will cause a corresponding movement of the sighting bead 294 in a vertical plane 312 for providing a proper angle 132 for other selected distances to desired arrow 116 destinations such as the destination 128. The configuration of the camming slot 270 may be empirically created by plotting points on an unslotted camming arm 268 under carefully controlled bow 110 aiming conditions at several different target distances throughout the range settings of the range adjustment wheel 22 of the range finder 12. Such plotted points on the camming arm 268 may then be connected to form a guideline for cutting the camming slot 270 which will thereafter repetitively cause sighting bead 294 to effect a proper angle 132 for the selected distance to the target destination 128 by the range finder 12. The length of the camming slot 270 may be such that it limits the movement of the cam follower pin 272 and thereby the sighting bead 292 to the effective range of the bow 110 and/or the range finder 12.

As explained in connection with the FIG. 2 embodiment, repetitive accuracy depends upon unformity of mass of arrows 116 and repetitive uniformity of bow force against the arrow. To accommodate for different bow strengths and different arrow masses, the mounting plate 276 may be provided with calibrations 314 for appropriately positioning the sighting bead screw 284 along the slot 282. These calibrations 314 may be empirically located by carefully controlled bow 110 aiming conditions in manner similar to that explained above with respect to forming the camming slot 270.

Figure 16:
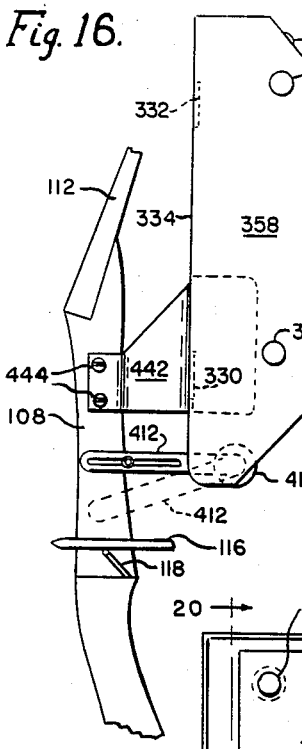
FIG. 16 is a side elevational view of a fourth embodiment of a sighting device in accordance with the present invention and mounted to the rigid center portion of an archery bow, only a portion of which is shown together with a portion of an arrow.
Figure 17:
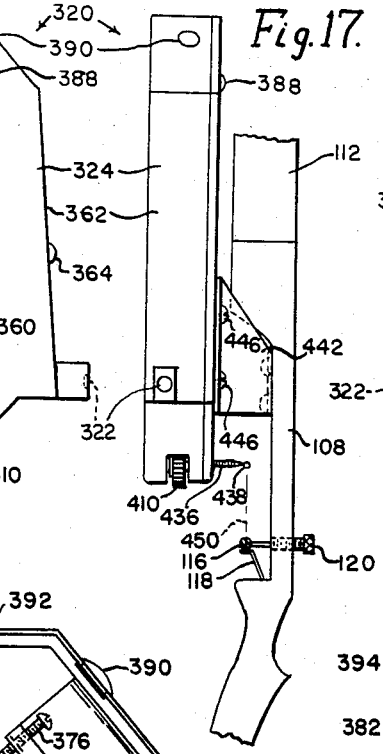
FIG. 17 is a rear view of the FIG. 16 illustration.
Figure 18:
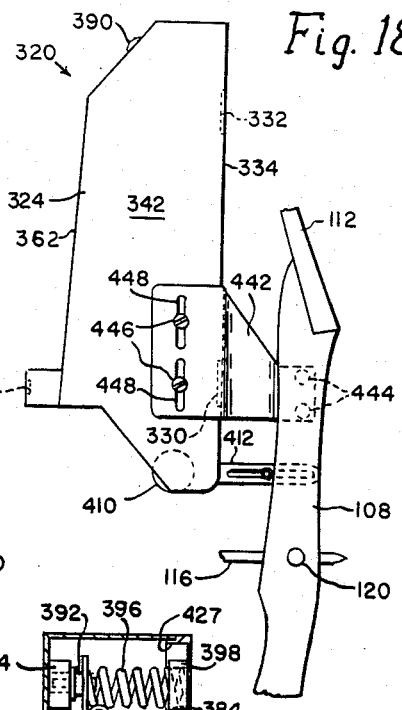
FIG. 18 is a side elevational view of the FIG. 16 illustration showing the opposite side from that in the FIG. 16 illustration.

A fourth embodiment of an archery bow sighting device constructed in accordance with the present invention is shown in FIGS. 16 through 20 and designated generally by the numeral 320. To facilitate brevity in description and ease in understanding, the bow and arrow sighting embodiment 320 is shown in FIGS. 16 through 18 as being mounted to a bow and arrow structure like that shown and described with respect to FIGS. 1 through 9 and therefor such like parts are identified by like numbers as those in FIGS. 1 through 9. However, it should be understood that such similarity of parts are for ease of illustration and understanding only and are not intended to limit the type of bow and arrow structure to which the present sighting invention embodiment is applicable.

Referring to FIGS. 16 through 20 in more detail, the bow and arrow sighting embodiment 320 includes a coincident image range finder having a viewfinder window 322 at the backside of the sighting device housing 324 for viewing a target image appearing on each of two mirrors 326 and 328 through windows 330 and 332 respectively in the front wall 334 of the housing 324. The mirror 330 is a half silvered or "beam splitter" mirror and is mounted by a mirror bracket 336 with screws 338 to lugs 340 fixed to the sidewall 342 of the housing 324. The mirror bracket 336 is preferably of a single piece of sheet metal formed with a mirror holder portion 344 whose angle with respect to window 330 is adjustable by an adjustment screw 346 carried in a threaded hole in the upper end of the mirror adjustment portion 348, the lower end of which is joined by the reverse bend portion 350 to the lower end of the mirror holder portion 344. The mirror bracket 336 also has a double reverse bend portion 352, the top member 354 of which carries in a threaded hole an adjusting screw 356 for lateral adjustment of the mirror 326 due to flexibility created by the double bend portion 352. The adjusting screw 356 is accessible with a screwdriver through a hole in the sidewall 358 normally closed by a removeable rubber plug 360. Similarly the adjusting screw 346 is accessible with a screwdriver through a hole in the back wall 362 normally closed by a removable rubber plug 364. Openings 366 and 368 (FIG. 19) are provided in the mirror holder portion 344 and mirror adjustment portion 348 respectively to allow both reflected images from the mirror 328 and pass-through images from window 330 to pass through to the view finder window 322.

The upper mirror 328 is a fully silvered mirror and is mounted by mirror bracket 370 with screws or other suitable means (not shown) to the upper portion of a range mirror adjusting arm 372. The mirror bracket 370 is preferably of a single piece of sheet metal formed with a mirror holder portion 374 whose angle with respect to the window 332 is adjustable by an adjustment screw carried in a threaded hole in the upper end of the mirror adjustment portion 378, the lower end of which is joined by the reverse bend portion 380 to the mirror holder portion 374. The mirror bracket 370 also has a reverse bend base portion 382 (FIG. 20), the top member 384 of which carries in a threaded hole an adjusting screw 386 for lateral adjustment of the mirror 328 due to flexibility of the reverse bend in the reverse bend base portion 382. The adjustment screw 386 is accessible with a screwdriver through a hole in the sidewall 358 normally closed by a removeable rubber plug 388. Similarly, the adjusting screw 376 is accessible with a screwdriver through a hole in the slant portion of the back wall 362 normally closed by a removeable rubber plug 390.

The range mirror adjusting arm 372 has fixed to its upper end a pivot pin 392 carried at one end in a sleeve bearing anchored in the lug 394, the other end of the pivot pin 392 protrudes into one end of a spring 396 whose other end is anchored in lug 398 fixed to the wall 358. The spring 396 provides pressure against the range mirror adjusting arm 372 for therebypreventing the pivot pin and arm 372 from lateral movement.

The other end of the range mirror adjusting arm 372 has a cam follower wheel 400, such as a ball bearing race structure, rotatively mounted on a pin 402 fixed to the arm 372. A threaded shaft 404 is rotatively carried at its ends in sleeve bearings anchored in lugs 406 and 408 fixed to walls 324 and 358 respectively and has fixed thereto a range adjustment wheel 410 and one end of sight mounting arm 412 locked in place against the range adjustment wheel 410 by a nut 414 carried on the threaded shaft 404. One half of the periphery of the range adjustment wheel 410 has serrations for improved finger contact for manually rotating the range adjustment wheel 410 in unison with the sight mounting arm 412 about the common axis with the shaft 404. The other half of the range addjustment wheel 410 periphery is a range adjustment cam 416 held against the cam follower wheel 400 by a cam follower spring 418 having one end anchored about a cam follower spring anchor port 420 fixed to the side wall 342, and the other end held in a hole 422 in the range adjustment arm 372. Another spring 424 has one end anchored in a lug 426 fixed to the wall 358, and the other end carried on a spring anchoring pin 428 fixed to the range adjustment arm 372. The spring 424 maintains the range adjustment arm 472 against a slider pin 430 carried in lug 432 fixed to the wall 342.

Figure 19:
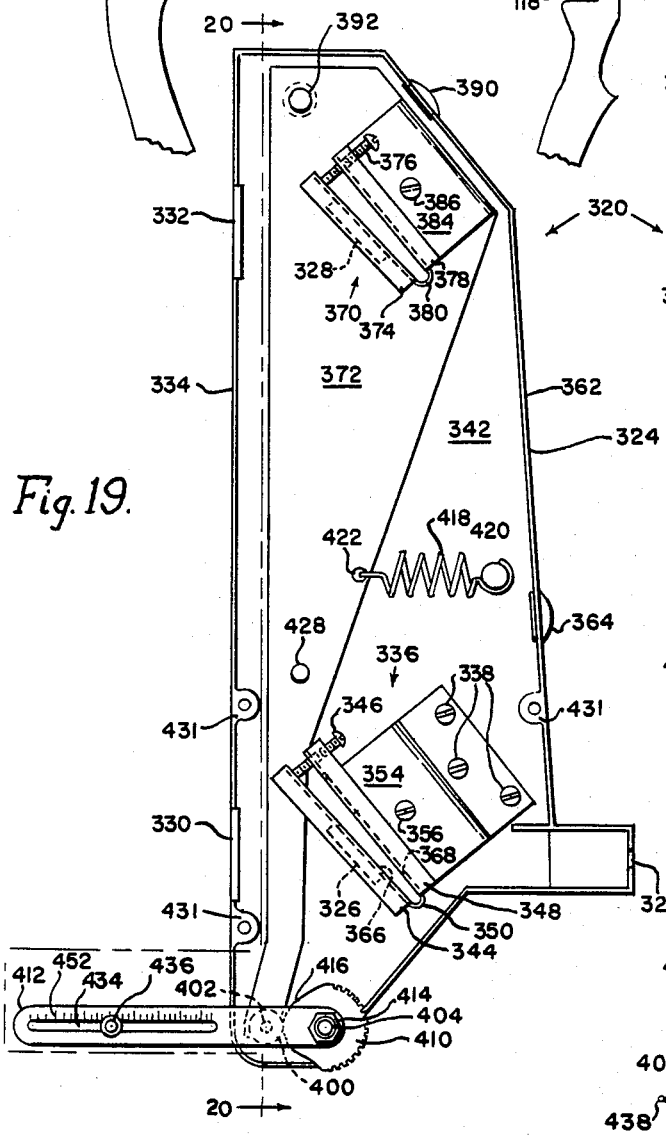
FIG. 19 is a side elevational view of the FIG. 16 embodiment to enlarged scale and with the cover at one side of the housing removed to more clearly show construction.
Figure 20:
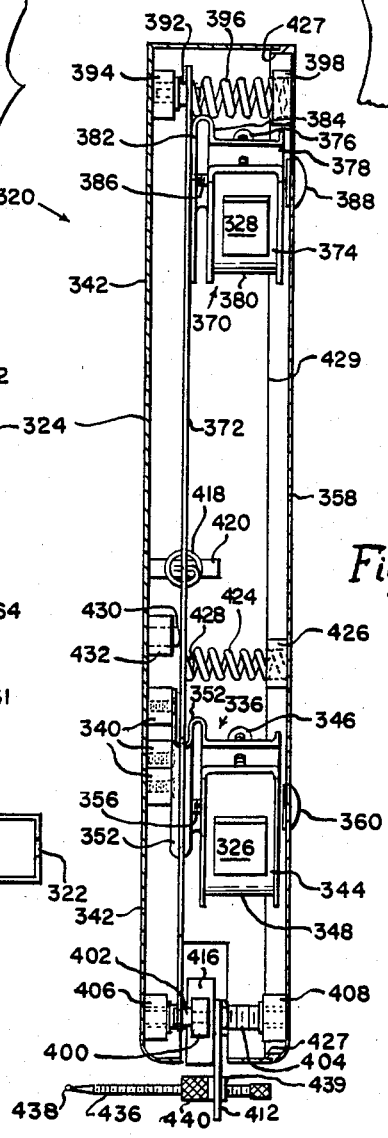
FIG. 20 is a view taken on line 20—20 of FIG. 19 and to the same scale as the FIG. 19 illustration and with the sighting bead mounting arm lowered to more clearly show construction.

The wall 358 may be considered to be a cover for the sighting device housing 324 in that it has a lip 427 about its periphery and is separable from the remainder of the housing 324 at the line 429 which characterizes the lip 427 overlapping the walls of the remainder of the housing 324. FIG. 19 is a view of the interior of the housing 324 with the cover wall 358 removed and carrying with it the lugs 398, 426 with springs 396 and 420 anchored therein, as well as the lug 408. Additional lugs such as 431 are provided as integral parts of the end walls and the cover wall 358 are receiving screws (not shown) for fastening the cover wall 358 in place.

The sight mounting arm 412 has a sight adjustment slot 434 in which is carried an elongated screw 436 which extends outwardly in perpendicular relation to the sightmounting arm 412 and carries a sighting bead 438 at one end. The sighting bead screw 436 is adjustably held in place in the slot 434 by a threaded bushing 438 and a threaded nut 440 similar to the bushing 286 and nut 290 respectively.

The bow and arrow sighting device 320 is carried on the rigid center portion 108 of the conventional bow 110 by a bracket 442 attached by screws 444 to the bow center portion 108 and by screws 446 in slots 448 to the side wall 342 of the housing 324.

In the operation of the bow and arrow sighting embodiment 320, procedure is similar to that described above with respect to the FIG. 2 embodiment. For example theslots 448 permit attachment to the archery bos 110 (FIG. 1) and adjustment to a position such that after the range adjustment wheel 410 has been adjusted for the distance to the intended destination such as point 128 of target 130, the sighting bead 438 with respect to the archer's eye 124 will be on a line of sight 126 directed at the point of destination 128 and the arrow 116 will be at an angle 132 with respect to a horizontal line 33 sufficient for the trajectory 134 of arrow 116 to reach the selected destination 128. Thereafter the cam 416 operated by movement of therange adjustment wheel 410 will cause a corresponding movement of the sighting bead 438 in a vertical plane 450 for providing a proper angle 132 for other selected distances to desired arrow 116 destinations such as the destination 128. The configuration of the camming surface 416 may be empirically created by first replacing the range adjustment wheel 410 with a wheel wherein the cam portion 416 is replaced by a cylindrical shape withradius smaller that the smallest part of the cam 416 radius. Then a spacer is placed between the cylindrical portion and the cam follower 400. The selected spacer is of a thickness which when engaging the cam follower 400 positions the mirror 328 for producing a target reflection for a target distance 130 at the view finder window 322 from mirror 326 coincident with the target appearing directly from window 330 through the mirror 326 to the view finder window 322 and the bead sight 438 and sight arm 412 being in the horizontal position shown in FIGS. 17 and 19 and provide the proper angular relation 132 for the desired trajectory to the target 128. For this initial setting the adjusting screws 376, 386, 346 and 356 may also be used as well as selecting a suitable measured distance 133 to the target 128. Thereafter, the careful aiming procedure is repeated several times with several spacers of known different thicknesses similarly inserted at the cam follower wheel 400 and the target moved to a measured distance where coincident images in each instance occur at the view finder window 322. Such spacer dimensions may then be used to plot the shape of the cam 416 which will thereafter repetitively cause sighting bead 438 to effect a proper angle 132 for the selected distance to the target destination 128. As explained in connection with the FIG. 2 embodiment, repetitive accuracy depends upon uniformity of mass of arrows 116 and repetitive uniformity of bow force against the arrow. To accomodate for different bow strengths and different arrow masses, the slot 434 may be provided with calibrations 452 for appropriately positioning the sighting bead screw 436 along the slot 434. These calibrations 452 may be empirically located by carefully controlled bow 110 aiming conditions inmanner similar to that explained above with respect to forming the camming surface 416.

This invention is not limited to the particular details of construction and operation as equivalents will suggest themselves to those skilled in the art.

What is claimed is:

1. In a sighting device for a bow and arrow the combination of a. a range finder of the type having a rotatable target range adjustment wheel member with a range adjustment angular displacement corresponding to distance to the target, b. a bow sighting member mounted for movement in a vertical plane when the sighting device is fixed to the bow and the bow and arrow are aimed at the target, and c. cam means coupled to responsive relation to said rotatable target range adjustment wheel member and in control relation to said bow sighting member for causing said bow sighting member to be moved in said vertical plane in response to rotation of said target range adjustment wheel member to a sighting position with respect to said bow such that said arrow is inclined with respect to the target by an amount corresponding to the displacement of said target range adjustment wheel member for the associated distance to the target.

2. The combination as in claim 1 wherein said cam means includes a gear controlled cam, gear means coupled in responsive relation to said wheel member and in control relation to said gear controlled cam, and a cam follower mechanism in responsive relation to said gear controlled cam for causing movement of said sighting member to said sighting position.

3. The combination as in claim 2 wherein said sighting member is a sighting bead and said gear means includes a driver and driven bevel gears with the driver gear and wheel having a common axis, and said cam and cam follower mechanism includes a cylindrical cam coupled to said driven gear for rotation about a common axis with said driven gear.

4. The combination as in claim 3 wherein said cam and cam follower mechanism includes in driven engagement with said cylindrical cam a cam follower mounted to slide in parallel relation to the cylindrical cam axis and having a transversely disposed slide arm, lever means mounted for rotation about a fixed axis and slidably engaging said slide arm for causing pivotal movement about said fixed axis in response to rotation of said cam, and means coupling said lever means at said fixed axis to said sighting bead for correspondingly moving said sighting bead in said vertical plane.

5. The combination as in claim 1 wherein said sighting member is a sighting glass, and said sighting member moving means includes a parallelogram structure for maintaining said sighting glass in operative position in said vertical plane.

6. The combination as in claim 5 wherein said sighting member moving means also includes a cam and cam follower mechanism for causing movement of said sighting glass through said parallelogram structure to said sighting position.

7. The combination as in claim 6 wherein said moveable target range adjustment member is a manually rotatable wheel, said range adjustment displacement is an angular displacement of said wheel, and said sighting member moving means includes gears coupled for transmitting said wheel displacement to said cam and cam follower mechanism for causing said movement of the sighting glass through said parallelogram structure.

8. The combination as in claim 7 wherein said gears are a driver and driven bevel gears with the driver gear and wheel having a common axis, and said cam and cam follower mechanism includes a cylindrical cam coupled to said driven gear for rotation about a common axis with said driven gear.

9. The combination as in claim 8 wherein said cam and cam follower mechanism includes a driven engagement with said cylindrical cam a cam follower mounted to slide in parallel relation to the cylindrical cam axis and having a transversely disposed slide arm, lever means mounted for rotation about a fixed axis and slidably engaging said slide arm for causing pivotal movement about said fixed axis in response to rotation of said cylindrical cam and coupled through said parallelogram structure to said sighting glass for correspondingly moving said sighting glass in operative position in said vertical plane.

10. The combination as in claim 2 wherein said gear means includes a driver and driven helical gears with driver helical gear and target range adjustment wheel member being coupled for rotation in response to rotation of said target range adjustment wheel member, and said cam and cam follower mechanism includes a cam arm mounted to rotate in a single plane in unison with said driven helical gear about a common axis with said driven helical gear.

11. The combination as in claim 10 wherein said cam arm has a camming formation distal from said cam arm axis, and a cam follower member in responsive relation to said camming formation and mounted to pivot about an axis parallel to the axis of said cam arm and having said sighting bead fixed to said cam follower member at a position distal from said pivot axis.

12. The combination as in claim 10 wherein said driver and driven helical gears are a worm and worm gear respectively.

13. The combination as in claim 11 wherein said sighting element is a sighting bead and said cam follower member includes means for adjusting the position of said sighting bead for variation in bow strength.

14. The combination as in claim 11 wherein said camming formation is in the form of a camming slot with said responsive relation being in the form of a cam follower pin of said cam follower member riding in said camming slot for controlling pivotal movement of said cam follower member about said pivotal axis.

15. The combination as in claim 1 wherein said sighting member is mounted to move in said vertical plane about a common axis with said range adjustment wheel, and said cam means includes a cam mounted to move about said common axis in unison with said range adjustment wheel and sighting member.

16. The combination as in claim 15 wherein said range adjustment wheel is fixed to a shaft mounted for rotation about said common axis, said sighting member is carried on a sighting arm fixed to said shaft at a position distal from said sighting member for rotation in said vertical plane about said axis, and said cam is fixed to said shaft and has a camming formation distal from said axis, whereby effecting unison of angular movement about said axis by said range adjustment wheel, sighting member and camming formation.

17. The combination as in claim 16 wherein said range finder has a viewfinder and two mirrors displaced from each other and mounted for producing coincident images of said target at the viewfinder when in range determining relation to each other, one of said mirrors being carried on a pivotally mounted range finder arm maving a cam follower member thereon in following engagement with the camming formation of said cam.

18. The combination as in claim 16 wherein said sighting member is a sighting bead.

* * * * *